United States Patent [19]

Marino et al.

[11] Patent Number: 4,722,292

[45] Date of Patent: Feb. 2, 1988

[54] INFLATABLE REMOVABLE KEEL FOR INFLATABLE RUBBER BOATS

[75] Inventors: Colombo Marino, Carnago; Olgiati Giuseppe, Solbiate Olona, both of Italy

[73] Assignee: Resine Sintetiche Adamoli S.p.A., Varese, Italy

[21] Appl. No.: 878,112

[22] Filed: Jun. 24, 1986

[30] Foreign Application Priority Data

Jun. 28, 1985 [IT] Italy ..... 22340/85[U]

[51] Int. Cl.[4] ..... B63B 3/38; B63B 7/08

[52] U.S. Cl. ..... 114/140; 114/345

[58] Field of Search ..... 114/140, 345; 441/40

[56] References Cited

U.S. PATENT DOCUMENTS 2,949,616 8/1960 Desanges ..... 114/345

FOREIGN PATENT DOCUMENTS 937968 9/1963 United Kingdom ..... 114/345

*Primary Examiner*—Sherman D. Basinger

*Attorney, Agent, or Firm*—Ladas & Parry

[57] ABSTRACT

The present invention describes an inflatable, removable keel for use with an inflatable rubber boat. The keel is interposed between the dunnage and the bottom sheet of the boat and includes at least one tab pair connected to a rigid zone present on the keel. The tab pair bears gripping strips which are adapted to cooperate automatically and removably with complementary gripping strips found on the bottom sheet.

6 Claims, 2 Drawing Figures

INFLATABLE REMOVABLE KEEL FOR INFLATABLE RUBBER BOATS

BACKGROUND OF THE INVENTION

The present invention relates to an inflatable and removable keel for inflatable rubber boats.

As is known, because of stability and directionality reasons, some inflatable rubber boats, in particular those driven by an outboard motor, are provided with an open V-shaped bottom. This shape is obtained by means of an additional inflatable body, improperly called a "keel", which is interposed between the rubber boat dunnage and bottom sheet. These keels consist of a variable cross-section rectilinear bladder. According to an embodiment thereof these keels are removable and are threaded into a longitudinal pocket rigid with the bottom sheet. Such a solution is affected by some drawbacks. In fact, the pocket involves a useless material waste and requires great labor for the introduction of the keel, especially in the case of repair work on said keel.

Thus, the object of the present invention is to provide an inflatable keel in which the above-mentioned drawbacks are overcome and, in addition, is easy to be repaired and removed.

SUMMARY OF THE INVENTION

According to the invention this object and yet other objects will become more apparent from the following detailed description. The objects are achieved by an inflatable keel, which is provided with at least a zone rigid therewith bearing gripping strip lengths adapted to cooperate, in order to hold the keel in position, with complementary gripping strip lengths attached to the rubber boat bottom sheet.

The terms "gripping strips" and "complementary gripping strips" mean herein a textile strip material provided with hook members, cooperating with a textile strip material provided with loop members. These strips are, for example, known under the VELCRO trademark.

The invention will become more apparent from the following detailed description, given by way of example only, with reference to the accompanying drawings, where:

DESCRIPTION OF PREFERRED EMBODIMENTS

With reference to the figures, at 1 there has been indicated a conventional inflatable rubber boat which is provided, at the periphery thereof, with a plurality of bladders, effective to be individually inflated, defining a ring member 2 open at the stern where is provided a transom 3, made of sea plywood, to which a conventional outboard motor may be applied.

Figure 1:
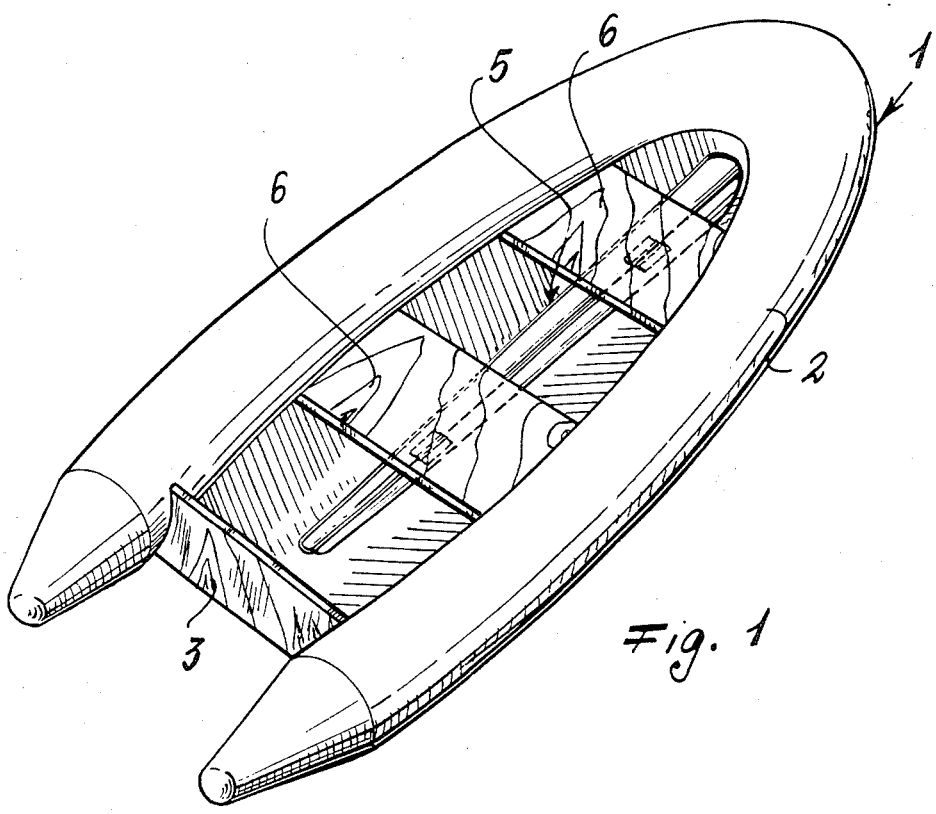
FIG. 1 is a perspective view illustrating a keel according to the invention as applied to a rubber boat which has been schematically represented by a thin, dashed line.
Figure 2:
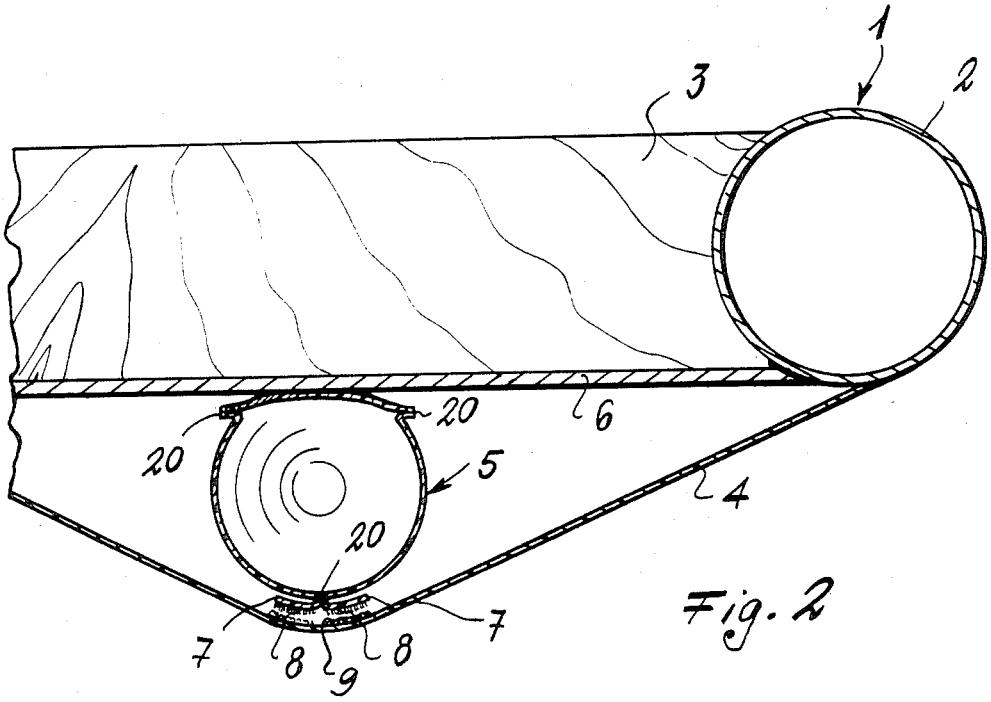
FIG. 2 is a schematic cross section view of the inflatable rubber boat shown in FIG. 1.

The boat comprises a bottom sheet 4 which is formed into a V-shape (see FIG. 2) by means of a variably cross-sectioned, elongated, inflatable tubular body 5 which is interposed between the conventional dunnage 6, made for example of sea plywood, and the bottom sheet 4. The body 5 extends longitudinally of the boat and gradually tapers toward the stern and, in a steeper manner, toward the bow. The body 5 is provided, at the bottom thereof, with two pairs of flexible tabs or wings 7 spaced from one another and formed from the same material as that of the body and which consist of plastics material sheets longitudinally welded or sealed at 20 in such a way as to form the closed tubular body. To each tab 7 (or other keel zone) on a face thereof, there are sealed lengths of a known gripping strip 8, that is a textile strip provided with a plurality of hook bent yarns. On the inner side of the bottom sheet 4, on both sides of the longitudinal boat middle line, and near this line, and in positions effective to allow for the strip length 8 tabs 7 to be superimposed, there are sealed complementary gripping strip lengths 9, (i.e a textile strip provided with a plurality of loops therewith) which can engage the hook bent yarns of the lengths 8, thereby the inflatable body 5 can be coupled, in an easy and removable way, to the bottom sheet 4 in the proper position.

The gripping strips may be the product sold under the trademark VELCRO. It should be apparent that the strips 8 and 9 may be reversed.

Thus, it will be clear that, by simple and inexpensive means, it is possible to removably and properly couple the tubular body 5 to the bottom sheet 4 of the boat 1.

What we claim is:

1. A removable inflatable keel interposed between the dunnage and the bottom sheet of a boat, said keel being comprised of:

at least a pair of flexible tabs having attached on at least one side thereof gripping strips;

said bottom sheet being comprised of: complementary gripping strips attached thereon for releasable automatic engagement with said gripping strips attached to said flexible tabs, such that said keel lies adjacent said dunnage on one side and on a generally opposite side is releasably attached to said bottom sheet, said attachment between said keel and said bottom sheet being through said gripping strips on said flexible tabs and said gripping strips on said bottom sheet.

2. The removable inflatable keel of claim 1 wherein said gripping strips on said flexible tabs are sealed to said flexible tabs and wherein said gripping strips on said bottom sheet are sealed to said bottom sheet.

3. The removable inflatable keel of claim 1 wherein said gripping strips on said tabs and on said bottom sheet are made of hook and loop members.

4. The removable inflatable keel of claim 1 wherein said keel includes a second pair of flexible tabs spaced from said first pair of flexible tabs, said second pair of flexible tabs having sealed on at least one side thereof gripping strips;

said bottom sheet including additional gripping strips for complementary releasable and automatic engagement with said gripping strips on said tabs.

5. The removable inflatable keel of claim 1 wherein said flexible tabs are longitudinally welded to form at least a portion of said keel.

6. The removable inflatable keel of claim 1 wherein said flexible tabs and said keel are made of a plastics sheet material.

* * * * *